US009913328B2

(12) United States Patent
van den Broeke

(10) Patent No.: US 9,913,328 B2
(45) **Date of Patent: *Mar. 6, 2018**

(54) LIGHTING CIRCUITS, LUMINARIES AND METHODS COMPATIBLE WITH PHASE-CUT MAINS SUPPLIES

(71) Applicant: Silergy Corp., Grand Cayman, Cayman Islands (GB)

(72) Inventor: Leendert van den Broeke, Nijmegen (NL)

(73) Assignee: Silergy Corp., Cayman Islands (GB)

( * ) Notice: Subject to any disclaimer, the term of this patent is extended or adjusted under 35 U.S.C. 154(b) by 0 days.

This patent is subject to a terminal disclaimer.

(21) Appl. No.: 15/193,846

(22) Filed: Jun. 27, 2016

(65) Prior Publication Data

US 2017/0181233 A1 Jun. 22, 2017

Related U.S. Application Data

(63) Continuation of application No. 14/714,059, filed on May 15, 2015, now Pat. No. 9,414,450.

(30) Foreign Application Priority Data

Jun. 9, 2014 (EP) ..... 14171661

(51) Int. Cl.
*H05B 33/08* (2006.01)

(52) U.S. Cl.
CPC ..... *H05B 33/0815* (2013.01); *H05B 33/0812* (2013.01); *H05B 33/0845* (2013.01)

(58) Field of Classification Search
CPC ..... H05B 33/0815; H05B 33/0845
See application file for complete search history.

(56) References Cited

U.S. PATENT DOCUMENTS

2007/0182338 A1 8/2007 Shteynberg et al.
2011/0121754 A1 5/2011 Shteynberg et al.
(Continued)

FOREIGN PATENT DOCUMENTS

GB 2507982 A 5/2014
WO 2013035045 A1 3/2013
WO 2014072847 A1 5/2014

OTHER PUBLICATIONS

Mercier, F. et al. "A Dimmable Power Supply Unit for Testing LED Lamps Built Around a Dedicated Integrated Circuit", IEEE Intl. Symp. on Industrial Electronics, pp. 1257-1262 (Jun. 2011).
(Continued)

*Primary Examiner* — Tung X Le
*Assistant Examiner* — Raymond R Chai

(57) ABSTRACT

Lighting circuits and luminaires and methods are disclosed which are operable with a phase-cut dimmer, A circuit can include a rectifier having a low side output and a high side output, a switched mode converter including a switch and an inductor, having a high side input connected to a bus rail, and having a configuration to draw current across a complete mains cycle a controller for the switched mode converter, a filter circuit connected between the rectifier high side output and the bus rail and including a capacitor connected between the high side output of the mains rectifier and ground, and a resistance connected between the low side output of the rectifier and ground. The value of the resistance may be such the RC time constant of the resistor and filter circuit is greater than the time required for any ringing in the circuit to fall to no more than 20 mA.

16 Claims, 9 Drawing Sheets

(56) References Cited

U.S. PATENT DOCUMENTS

| | | | | |
|---|---|---|---|---|
| 2012/0126714 | A1 | 5/2012 | Deppe et al. | |
| 2012/0286696 | A1* | 11/2012 | Ghanem | H05B 33/0815 315/291 |
| 2013/0057167 | A1* | 3/2013 | Angeles | H05B 33/0815 315/200 R |
| 2013/0127353 | A1* | 5/2013 | Athalye | H05B 33/0815 315/193 |
| 2014/0001979 | A1 | 1/2014 | Mercier et al. | |
| 2014/0063857 | A1 | 3/2014 | Peng et al. | |
| 2014/0103823 | A1 | 4/2014 | Kahlman et al. | |
| 2014/0111113 | A1 | 4/2014 | Del Carmen, Jr. | |
| 2014/0300289 | A1* | 10/2014 | Zhu | H05B 33/0815 315/206 |

OTHER PUBLICATIONS

Extended European Search Report for EP Patent Appln. No. 14171661.3 (Feb. 4, 2015).

* cited by examiner

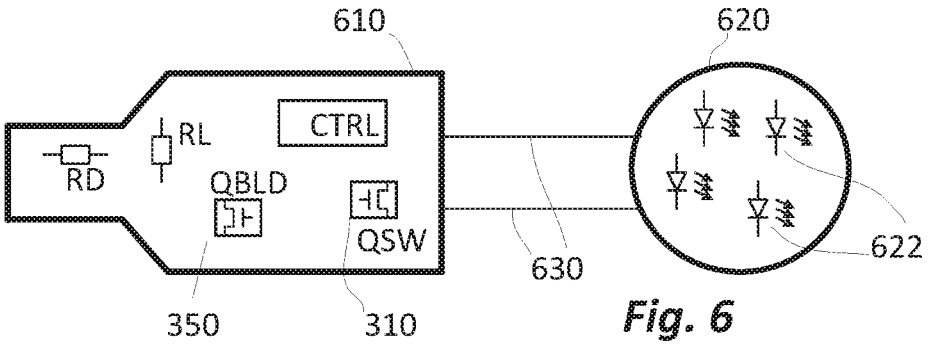
Fig. 6
(PRIOR ART)
Fig. 7
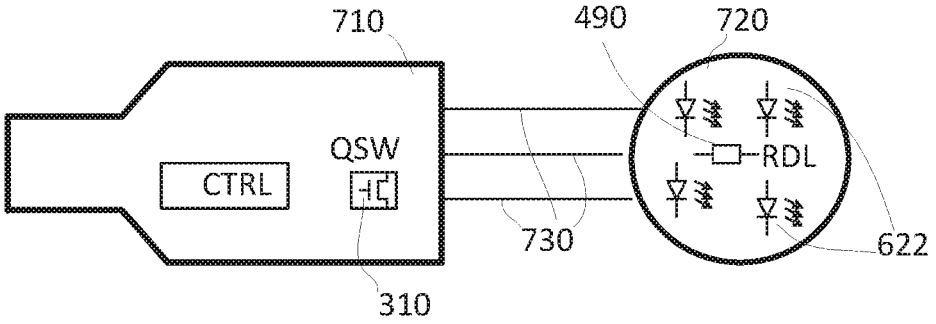

LIGHTING CIRCUITS, LUMINARIES AND METHODS COMPATIBLE WITH PHASE-CUT MAINS SUPPLIES

CROSS-REFERENCE TO RELATED APPLICATIONS

This application is a continuation of the following application, U.S. patent application Ser. No. 14/714,059, filed on May 15, 2015, and which is hereby incorporated by reference as if it is set forth in full in this specification, and which also claims the priority under 35 U.S.C. § 119 of European patent application no. 14171661.3, filed on Jun. 9, 2014, the contents of which are incorporated by reference herein.

FIELD

This invention relates to lighting circuits and luminaires. In particular it relates to circuit circuits and luminaires which are suitable for lighting applications operable with a phase-cut dimmer such as mains LED and similar low-impedance lighting applications.

BACKGROUND

Solid state light sources, such as LEDs, are increasingly popular for replacing incandescent light sources, due in part to their significantly lower energy consumption.

Currently, cost-effective solutions for non-dimmable solid state light sources are widely available; however, the cost of a solid state light source that is compatible with phase-cut dimmers is still significantly higher than an equivalent incandescent lamp. This is particularly true for phase cut dimmable light sources for "high mains voltage" such as 220-240V as used in Europe and Asia: the current drawn by a standard solid state light source, used to replace an incandescent lamp of, for example, 40 W is not enough to ensure that the phase cut dimmer behaves properly; moreover, for forward phase-cut dimmers, the non-resistive input impedance of the converter tends to amplify ringing at dimmer turn-on, resulting in erratic behaviour of the dimmer.

For lower mains voltages, such as the 120V mains applications typical in the US, the impedance level is relatively lower (that is, the current to produce the same power level is relatively higher) and smaller dimmer EMI filter inductances are used (of the order of 100 μH as compared to 1 to 5 mH for 230V mains). It thus is easier to keep the dimmer operating properly with limited hardware expense. Such solutions generally are not universally applicable since they cannot be readily extended to higher mains voltages, and in particular to 220-240V for Europe and Asia.

In order to mitigate the effects of a low input current for 230V mains applications, conventional solid state lighting contains functions that in effect mimic an incandescent load: that is to say, they typically include the following three features, which are illustrated with reference to FIG. 1. FIG. 1 shows the voltage and current waveforms for a forward phase-cut dimmer: the top curve 110 shows the input voltage from a forward phase-cut dimmer; the middle curve 120 shows the input current drawn by a 60 W incandescent light source, and the bottom curve 130 shows the input current drawn by a solid state light source.

Firstly, a resistive damper that damps the ringing immediately following turn-on of a forward phase-cut dimmer, for typically 100 μs, shown at 132 in FIG. 1. The ringing results from the dimmer's EMI filter, consisting of an inductor and a capacitor, and the EMI filter in the solid state light source, consisting of one or more inductors and capacitors. Secondly, an RC latch that, at least until the ringing has damped to an amplitude of a only a few tens of milliamperes (mA), draws additional current, thereby providing a positive offset in the current to prevent the ringing from reversing the input current. Typically, this latching current is required for between 50 μs and 300 μs starting from the dimmer turn-on-moment, that is, across regions 132 and 134 of FIG. 1. This RC latch precludes the dimmer conduction current from being at or around zero for too long—that is, for more than a few tens of μs; were this to occur, the triac which is typically used as the dimmer switching device would stop conducting, causing erroneous behaviour. And thirdly, a bleeder that can draw additional DC-current towards the end of the dimmer conduction phase (136 in FIG. 1) to satisfy the dimmer hold current and keep the input voltage low while the dimmer switch is non-conductive (138 in FIG. 1) but still needs some load. The current to be drawn during the non-conduction time is sometimes loosely called the dimmer reset current.

FIG. 2 shows the voltage and current waveforms for a backward phase-cut dimmer; the top curve 210 shows the input voltage from a backwards phase-cut dimmer, the second curve from the top curve 220 shows the input current drawn by a 60 W incandescent light source, the third 230 and bottom 240 curves show the input current drawn by a two different solid state light sources. It will be appreciated that for a backward phase-cut dimmer, the waveforms will appear mirrored, and the ringing due to the steep dVdt at switch-on of a forward phase-cut dimmer will be absent, relative to a forward phase-cut dimmer.

During the dimmer conduction time 232, the light needs to draw at least some current to track the wave form from the backward phase-cut dimmer, in particular when the phase of the mains signal exceeds 90°. After the dimmer conduction has stopped, shown at 234 and 244, the light needs to draw significant current in order to follow the falling edge of the dimmer signal (the current is required in order to discharge the dimmer EMI filter capacitor that is placed across the dimmer switch). During the dimmer no-conduction time 236 of a backward phase-cut dimmer, the light typically needs to draw some current to charge the dimmer's internal supply.

A simplified schematic of a conventional LED lighting circuit is shown in FIG. 3. The figure shows a lighting circuit 300 for a low impedance lighting application, shown as LEDs 394, supplied from a mains, in this case at 230V, via a dimmer 392. The circuit comprises a series resistor RD at the input to a bridge rectifier BD1. Across the bridge rectifier is a series combination of a latch resistor RL and a capacitor CL. The ringing at turn-on is damped primarily by the series resistor RD at the input and, to a lesser extent, by the latch resistor RL. In order to minimise the losses, the damping resistor is chosen to be low-ohmic, and is typically of the order of 50-5000. This is the case wherever in the circuit RD is positioned. The temporary latching current (which is typically of the order of 400 mA) is drawn by the series network of RL and CL; a typical time constant, for which this current is drawn, for 230V systems is of the order of 250 μs. It will be appreciated that for 120V systems, the time constant is much shorter, such as 50 μs.

The lighting circuit include a switched mode converter 315 comprising a switch QSW 310 in series with an inductor L2 320. The switch is controlled by controller 330 and dimmer controller 340, which in some configurations may be part of the switched mode converter 315, although in other configurations it may be considered to be separate as shown. A bleed current is drawn by the power transistor QBLD 350, which is controlled by a bleeder controller 360. Sometimes, in order to distribute the heat dissipation, a bleeder resistor may be used in series with the bleeder switch 360. During dimmer conduction, the bleed current may ramp up to typically 15-50 mA, whereas during dimmer non-conduction, the bleed current is only few mA.

The lighting circuit includes an EMI filter 305, which will be familiar to the skilled person, and comprises an inductor L1 between the output of the bridge rectifier BD, (shown as VRECT) and the switched mode converter input bus rail VBUS. Capacitor C1 and C2 are connected between the ground of the switched mode converter and either end of the inductor respectively.

As is clear from FIG. 3, the circuitry to provide the bleeder, latch and damping functions requires additional components, which may have consequences for any of the cost of, electrical losses in or thermal management of the circuit.

SUMMARY

According to a first aspect there is provided a lighting circuit for mains LED lighting applications operable with a phase-cut dimmer, wherein the mains has a maximum voltage which is at least 200V, the circuit comprising a rectifier having a low side output and a high side output; a switched mode converter comprising a switch and an inductor, having a high side input connected to a bus rail, and having a configuration so as to draw current from the mains across a complete mains cycle; a controller for the switched mode converter; a filter circuit connected between the rectifier high side output and the bus rail and comprising a capacitor connected between the high side output of the rectifier and ground; and a combined damping/latch resistance or resistor connected between the low side output of the rectifier and ground. The rectifier may be a mains rectifier. The switched mode converter may have a low side input connected to the ground.

Thus, according to this aspect, the requirement for a separate bleed circuit may be replaced for appropriate circuit design, in which damping and latching functions are combined into a single impedance, and particularly a single resistance. The single impedance unit may be implemented as a single resistor, although of course, the skilled person will appreciate that the single impedance may alternatively be implemented as two or more resistors in a series or parallel arrangement. Avoiding the requirement for a separate bleed circuit, and combining the damping and latching functions into a single impedance unit may simplify the circuit design resulting in cost savings, or lower thermal dissipation, or thermal dissipation which is more convenient to handle.

In one or more embodiments, the value of the combined damping/latch resistance is such that the RC time constant of the combined damping/latch resistance and filter circuit is greater than the time required for any ringing in the circuit to fall to no more than 20 mA. Such ringing generally arises, in use, from the switch-on of the phase-cut dimmer, which is typically near-instantaneous.

In one or more embodiments, the RC time constant of the combined damping/latch resistance and filter circuit is between 50 μs and 300 μs. In order to achieve such a time constant for operation with currently commercially available dimmers, the value of the combined damping/latching resistance may generally be between 500 and 1 kΩ, and in a particular application may be between 1500 and 5600. Thus, in one or more embodiments, the value of the combined damping/latch resistance is between 1500 and 5600.

In one or more embodiments, the switched mode converter is a one of a buck-boost converter and a fly-back converter. In other embodiments, the switched mode converter may be a boost converter. In one or more embodiments, the controller is configured to operate the switched mode converter in boundary conduction mode.

In one or more embodiments, the lighting circuit further comprises a waveform shaping circuit arranged to provide a higher input current to the converter when a momentary phase of the mains input signal exceeds 90°, relative to the current to the converter when the mains phase is less than 90°. This may help to ensure the total circuit draws input current across the whole mains cycles over a wider range of operating conditions. In one or more embodiments, the controller is configured to operate the switched mode convertor using on-time control. Unlike peak current control, on-time control generally results in a resistive input impedance of the switched mode converter; this may speed up the damping of the ringing.

In one or more embodiments, the filter circuit further comprises both an inductor between the rectifier high side output and the bus rail and a further capacitor connected between the bus rail and ground. In one or more embodiments, the lighting circuit further comprises one of more LEDs.

In one or more embodiments, the lighting circuit further comprise a bypass switch, arranged and configured to, in use, provide a bypass path to bypass the combined damping/latching resistance at the end of a predetermined interval from a moment the dimmer starts conducting. Thereby, once the combined damping/latching resistance has performed its intended function, the losses which would otherwise result from its continued presence in the circuit for the remainder of the switching cycle may potentially be reduced or even eliminated. The predetermined time may be the time required for any ringing in the circuit to fall to no more than only a few tens of milliamps (mA), or to no more than 20 mA.

According to another aspect there is provided a populated driver circuit board comprising a mains rectifier, a switched mode converter and a filter circuit, each as just discussed or defined and mounted on a common printed circuit board, and configured and adapted to operate in a lighting circuit just discussed.

According to a further aspect there is provided any of the above lighting circuits comprising such a populated driver circuit board, and a populated LED circuit board comprising at least one LED and the resistor or resistance. Mounting, or populating, the resistor onto the LED circuit board rather than onto the driver circuit board may thereby reduce the heat dissipation of the populated driver circuit board, which may in turn make the thermal management of that board, and possibly of the system as a whole, simpler or easier.

In one or more embodiments, electrical connection between the populated driver circuit board and the populated LED circuit board is provided by three conductors.

According to a yet further aspect there is provided a luminaire comprising such a lighting circuit in a housing.

These and other aspects of the invention will be apparent from, and elucidated with reference to, the embodiments described hereinafter.

BRIEF DESCRIPTION OF DRAWINGS

Embodiments of the invention will be described, by way of example only, with reference to the drawings, in which

FIG. 6 shows in schematic form a conventional arrangement of components on two circuit boards;

FIG. 7 shows in schematic form an arrangement of components on two circuit boards for lighting circuits according to embodiments;

Figure 1:
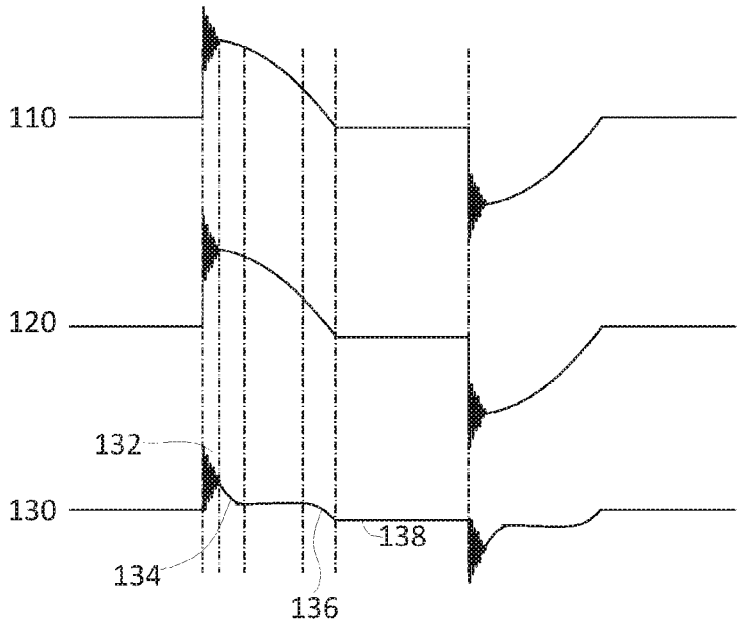
Fig. 1 (PRIOR ART)
FIG. 1 shows the voltage and current waveforms for a forward phase-cut dimmer.
Figure 2:
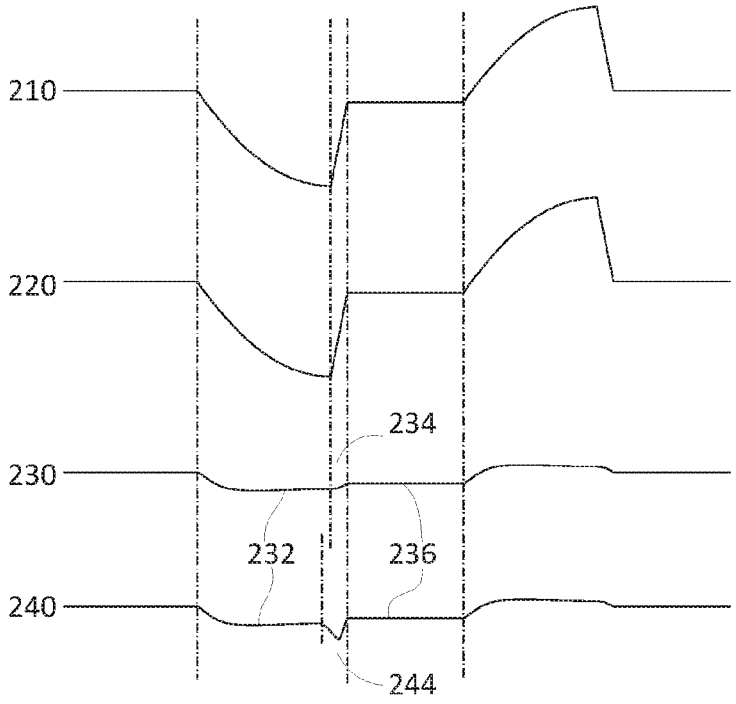
Fig. 2 (PRIOR ART)
FIG. 2 shows the voltage and current waveforms for a back-wards phase-cut dimmer.

It should be noted that the Figures are diagrammatic and not drawn to scale. Relative dimensions and proportions of parts of these Figures have been shown exaggerated or reduced in size, for the sake of clarity and convenience in the drawings. The same reference signs are generally used to refer to corresponding or similar features in modified and different embodiments

DETAILED DESCRIPTION OF EMBODIMENTS

Figure 4:
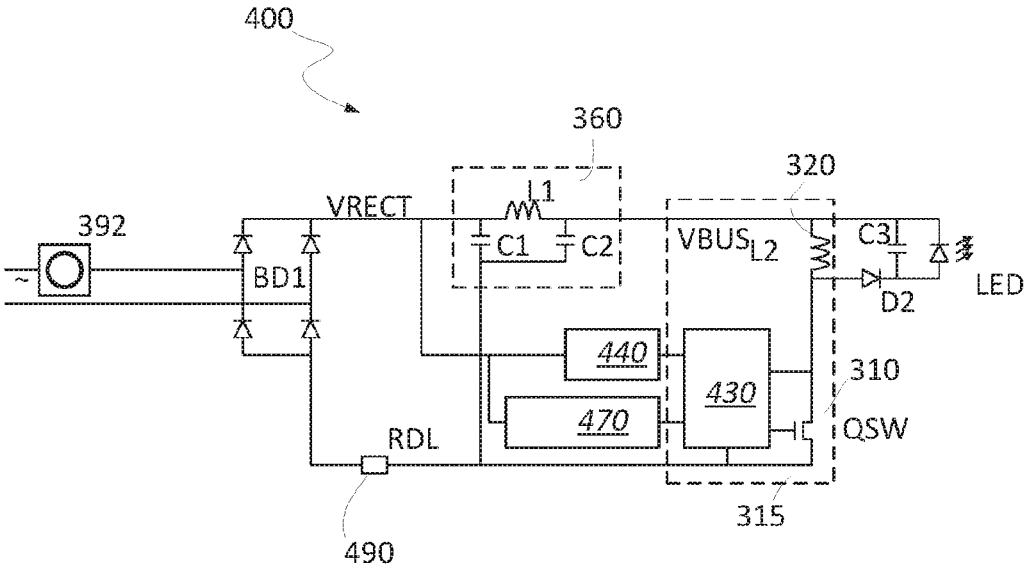
FIG. 4 shows a simplified schematic of a phase-cut dimmable low-side buck-boost lighting circuit 400 according to embodiments.

FIG. 4 shows a simplified schematic of a phase-cut dimmable low-side buck-boost lighting circuit 400 according to embodiments. Similarly to conventional circuit, the circuit is supplied from an AC mains, which may be a 230V mains, via a phase cut dimmer 392, and supplies a low impedance light source which may be as shown one or more LEDs.

Figure 3:
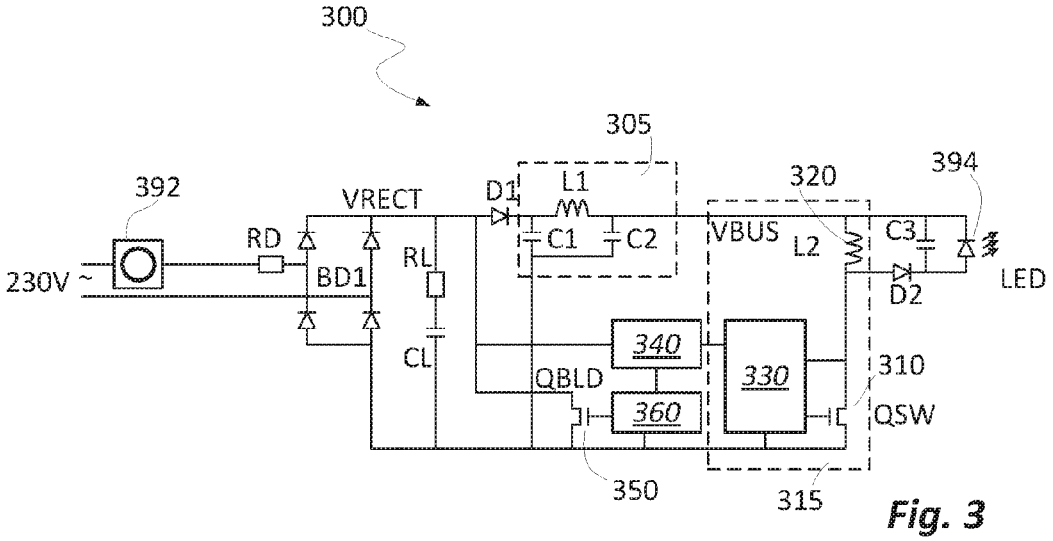
Fig. 3 (PRIOR ART)
FIG. 3 shows a simplified schematic of a conventional LED lighting circuit.

The circuit comprises a bridge rectifier BD1; however in this case, there is no requirement for a series resistor RD. The lighting circuit include a switched mode converter 315 comprising a switch QSW 310 in series with an inductor L2 320. Herein, the terms switch mode converter and switched mode power converter will be considered interchangeable. The switch is controlled by controller 430 and dimming controller 440. In contrast to the conventional circuit shown in FIG. 3, there is no bleeder switch or bleeder controller 360. In contrast to conventional circuits, the embodiment shown in FIG. 4 includes a resistor RDL 490 between the low side output of the bridge rectifier BD1 and the ground of the switched mode converter 315, which acts to combine the functions of the damping and latching. Although in FIG. 4 of the combined damping/latching resistance RDL 490 is shown on the output side of the bridge rectifier, in other embodiments it may be arranged on the input side instead. The skilled person will appreciate that the resistance will generally be provided as a single resistor as shown, although two or more resistors in a series, parallel or mixed series-parallel arrangements are not excluded. The value of the combined damping/latching resistance RDL is chosen in conjunction with the conventional EMI filter 360. The "RC" time constant of the combination of the resistor and filter should be sufficient to provide a latching current for sufficient time to ensure that, in the event that phase cut dimmer is forwards phase cut—that is to say, it is a leading edge dimmer—the phase cut dimmer properly latches on upon turn-on of the dimmer switching element. For a typical 230V system, the latching current may be required for approximately 250 μs, and thus the time constant of the RC circuit will typically be of the order of 50 μs to 300 μs. The skilled person will be aware that the term "time constant", when used in relation to an RC circuit, is the relaxation time, for a current (or voltage) to damp to a factor of 1/e—that is to say, to 37%—of its initial pre-relaxation value.

Whereas it is known to include a resistor in lighting circuits for the purposes of limiting in-rush current, or to provide damping of any ringing, the value of such an in-rush limiter resistor would be insufficient to provide a latching function, Such an in-rush limiter, or damping, resistor may typically be a few ohms, as mentioned above, and generally not more than a 20Ω, in particular, the higher the value, the greater the loss which would be expected. In contrast, in embodiments, the value of the combined damping/latching resistance RDL is higher, in particular to enable the latching function. In typical applications, the value of the combined damping/latching resistance RDL may be between 50Ω, and 1 kΩ. In prototypes, the value is between 150Ω, and 560Ω, and in a specific example embodiment for a 5 W rated light, a value of 560Ω±20%, has been found to be effective.

The configuration of the switched mode converter is chosen so as to draw current across the whole mains cycle, including near mains crossings when the values of the rectified input voltage VRECT and VBUS are relatively low. This may be readily achieved by appropriate selection of the type of switched mode converter. Commonly used converters such as buck boost, flyback or boost converters all satisfy this requirement, as do some other known converter types—such as Sepic converters. Thereby, the requirement for a separate bleed current (provided using a bleeder switch and optional series resistor) may be avoided.

In order to prevent that the dimmer might stop conducting, it may be desirable that, the circuit draws a sufficient holding current such that the average input current does not fall to zero during the dimmer conduction time. Since some of the current to drive the switched mode converter is derived from the discharge current from the capacitors C1 and C2 within the EMI filter, this may be considered to be equivalent to the converter input current exceeding a certain minimum level when the momentary phase of the input signal exceeds 90 degrees. This is generally fulfilled by using either a buck-boost or fly-back converter, operating in boundary conduction mode, and/or choice of suitable low voltage LEDs.

Figure 5:
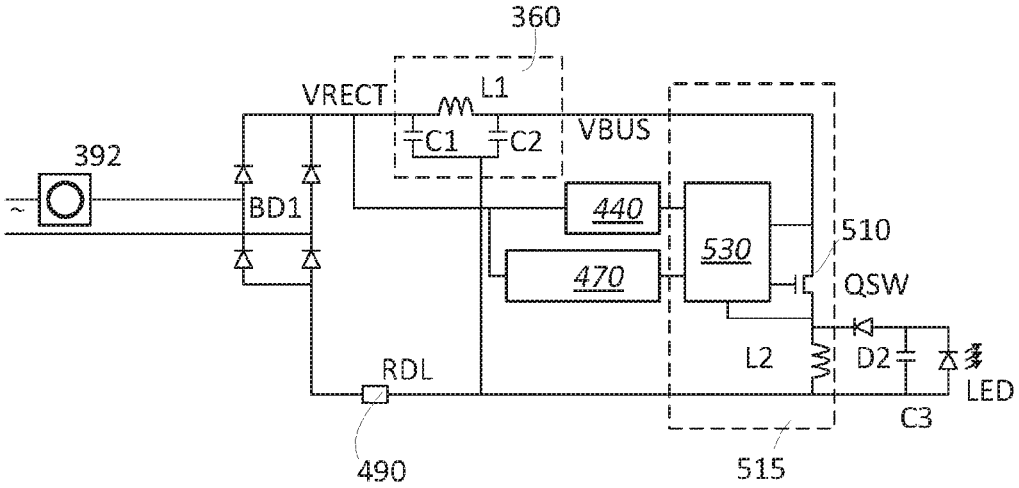
FIG. 5 shows an embodiment in which the switched mode converter is a high side buck boost converter.

FIG. 5 shows an embodiment which is similar to FIG. 4, but this time the switched mode converter 515 is a high side buck boost converter under the control of controller 530, as can be seen from the arrangement of the switch QSW 510 between the bus rail and the inductor L2, rather than the inductor L2 being between the switch QSW 310 and the bus rail which is the case in the embodiment shown in FIG. 4. Similarly to the embodiment shown in FIG. 4, this embodiment does not include a separate bleed current (comprising a bleeder switch and optional series resistor).

The embodiments shown in FIGS. 4 and 5 both include a waveform shaper, 470. In other embodiments, a waveform shaper is not included. In the embodiments shown in FIGS.

4 and 5, the waveform shaper is a circuit which increases the converter input current when the momentary phase of the AC input signal exceeds 90°, relative to the converter input current when the momentary phase of the AC input is 90° or less. By convention the phase of an AC signal is 0° at the positive-going zero crossing of the AC. The waveform shaper thus results in the converter having a higher input current whilst the AC voltage is decreasing, relative to the input current whilst the AC current is increasing. Inclusion of such a waveform shaper may enable the circuit to work with higher voltage LEDs than would be the case without it.

The skilled person will appreciate that use of a combined damping/latching resistance RDL 490, may enable simplified thermal management of the circuit, relative to conventional circuits in which there might be thermal dissipation in multiple components, such as a bleeder, and a latch resistor, and a damping resistor. In particular, many designs of LED lighting circuits include two circuit boards. One of the circuit boards is populated with the LEDs, and the other circuit board is populated with the control circuitry. In such designs there may be several heat dissipating components on the control circuit board. Such an arrangement is shown schematically in FIG. 6, which shows schematically two circuit boards 610 and 620. The first circuit board 610, which may be a printed circuit board, is populated with components from the lighting circuit, including one or more controllers CTRL (such as switch controller 330, dimmer controller 340 and bleeder controller 360 of FIG. 4), together with the switched mode converter switch QSW 310, the bleeder switch QBLD 350 latch resistor RL and damping resistor RD. Some circuits include a bleed resistor (not shown) associated with the bleeder switch. Circuit board 620, which may be printed circuit board, is populated with one or more LEDs 622. The two circuit boards are connected by two conductors 630, which may, without limitation, be in the form of wires or, for rigid connection between the boards, be in the forms of pins.

FIG. 7 shows schematically the arrangement of two circuit boards 710 and 720 for lighting circuits according to embodiments. In comparison with the arrangement of FIG. 6, it is immediately apparent that there are fewer dissipating components overall, since there is no requirement for separate latch resistor RL and damping resistor RD, nor for a bleeder switch QBLD or bleed resistor. Furthermore, by the inclusion of just one additional conductor—resulting in a total of 3 conductors 730 to connect the two circuit boards 710 and 720—it is possible to physically locate the combined damping/latching resistance RDL 490 onto the LEDs circuit board 720. Since this might be the only dissipating resistor in designs according to embodiments, it may be possible to significantly reduce the heat dissipation in the driver board, which may, as a result, reduce the requirement for, and thus the cost of, cooling of the driver board.

Figure 8:
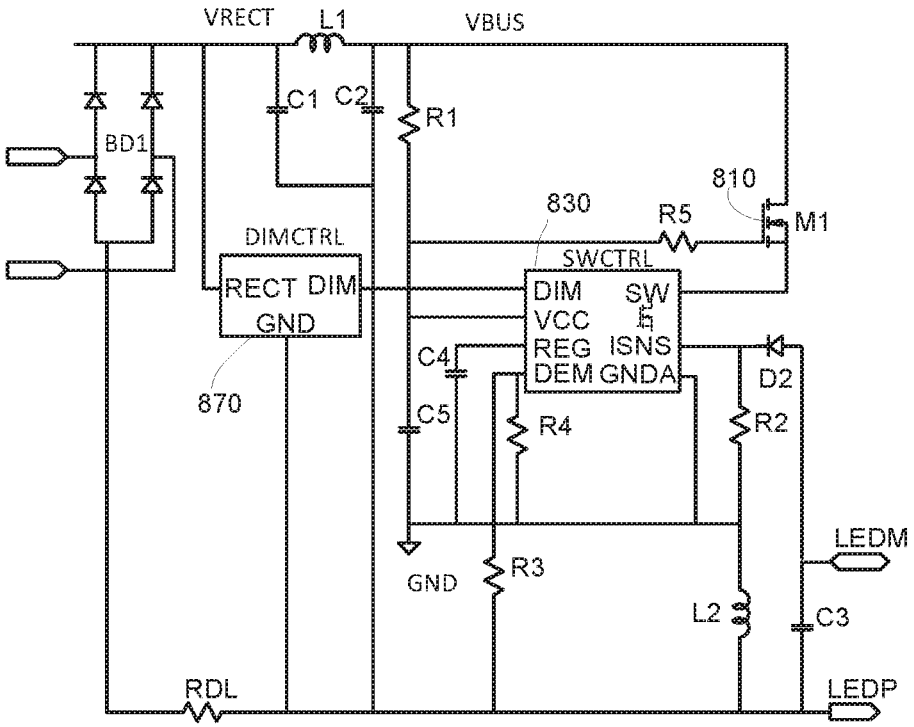
FIG. 8 shows a schematic of an embodiment in buck-boost topology

FIG. 8 shows a schematic of an embodiment in buck-boost topology. The dimmer control unit DIMCTRL 870 processes the rectified input voltage VRECT and, depending on the conduction angle of the connected phase-cut dimmer, provides a set point to a DIM pin of the switch controller SWCTRL 830. The switch controller includes DIM, Vcc, REG, DEM (also sometimes terms DEMOVP) SW, GNDA and ISNS pins, as will be explained in more detail below. The actual switch QSW (not separately shown) consists of the high-voltage switching element M1 complemented by a low voltage switching element inside switch controller 830 SWCTRL that is connected between pin SW and pin ISNS of SWCTRL.

During the primary stroke, the switch M1 is closed such that the current in inductor L2 ramps up for a predetermined on-time. After the on-time has expired, the switch is opened and the magnetic energy stored in L2 is released via diode D2 to the LED light source (not shown) that is, in operation, connected between the terminals LEDP and LEDM. The demagnetisation pin DEM detects the end of the secondary stroke, and the controller may apply valley switching, such that at the first valley of the voltage across the switch, a new switching cycle is started. Thus the converter operates in boundary conduction mode—in this case, with valley switching, as will be familiar to the skilled person.

The switch controller 830 features a DIM pin that sets the magnitude of the delivered output current: during the secondary stroke, the switch controller 830 senses the current that is delivered to the LED load by sensing the voltage across R2. The controller compares the sensed value with the value that is set at the DIM pin and regulates the on-time such that the delivered current matches the value set at the DIM pin. The REG pin is used to connect a filter element C4 that stabilizes the feedback loop. Power to the switch controller 830 is supplied to Vcc via resistor R1.

The shape of the average input current of the constant on-time boundary conduction, Iconv, converter depends on the ratio of the rectified input voltage VRECT and LED operating voltage Vled:

$$Iconv = \frac{Ton}{2\,L} VRECT \frac{Vled}{Vled + VRECT}$$

in which Ton denotes the constant on-time and L denotes the value of the switching inductor L2.

During the dimmer conduction time, the rectified input voltage is a pure sine wave with phase Phi, where Vpk is the peak mains voltage, and can be written as:

$$VRECT = |Vpk \sin(Phi)|$$

Figure 9:
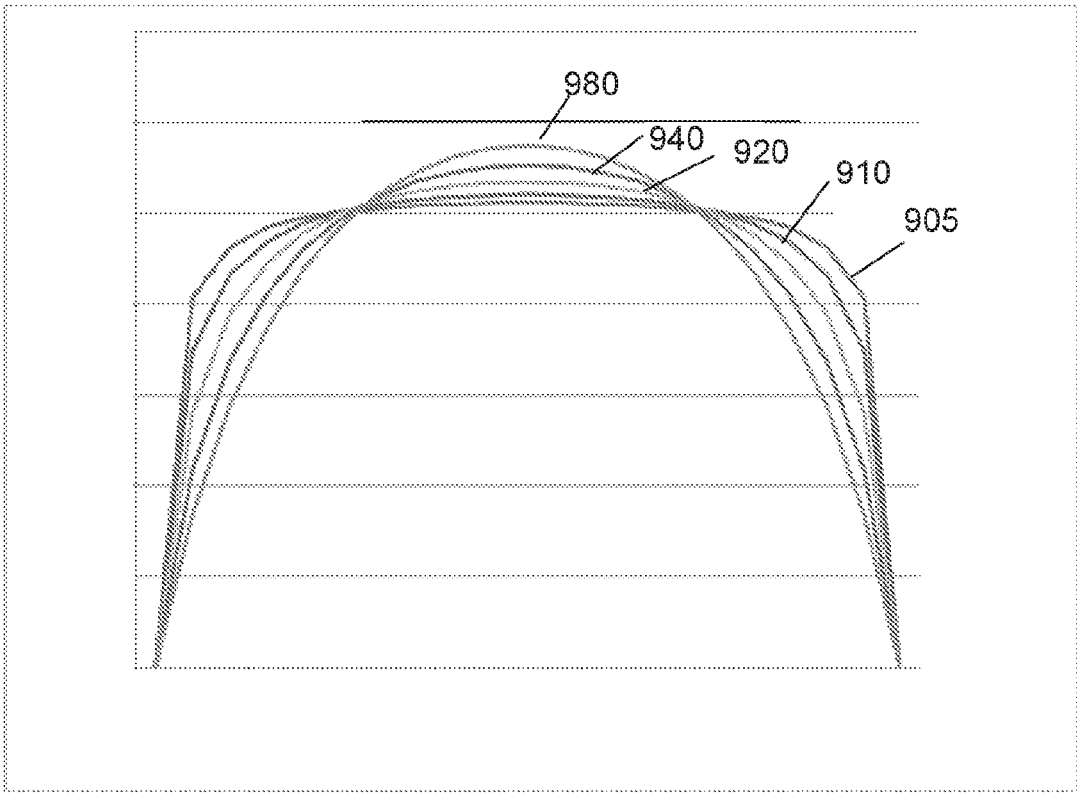
FIG. 9 shows the normalized converter input current, for different Vled:Vpk ratios.

FIG. 9 shows the normalized converter input current, on the y-axis or ordinate, for different ratios between Vled and Vpk, plotted against the phase Phi of the mains (between 0° and 180°) on the x-axis or abscissa. The Vled:Vpk ratios shown are respectively 0.05 (curve 905), 0.1 (curve 910), 0.2 (curve 920), 0.4 (curve 940) and 0.8 (curve 980). The figure clearly demonstrates that the input current tends to be flat when the LED voltage is low, for example 1/10 of the peak input voltage (32V for 320V peak at 230V RMS) as shown at curve 910. This can be understood by considering that for given Ton, the achieved peak inductor current is proportional to VRECT. Since the voltage across the inductor in the secondary stroke is constant (equals Vled), the length of the secondary stroke (Toff) will also be proportional to VRECT. Consider that due to the small ratio of Vled/VRECT, the switching frequency is mainly dependent on the length of the secondary stroke Tsec. So, although increasing VRECT increases the inductor peak current, increasing VRECT will equally decrease the switching frequency. As a result the average input current remains almost constant. This may be highly effective to keep a forward phase-cut dimmer conductive or track the trailing edge of a backward phase-cut dimmer.

Figure 10:
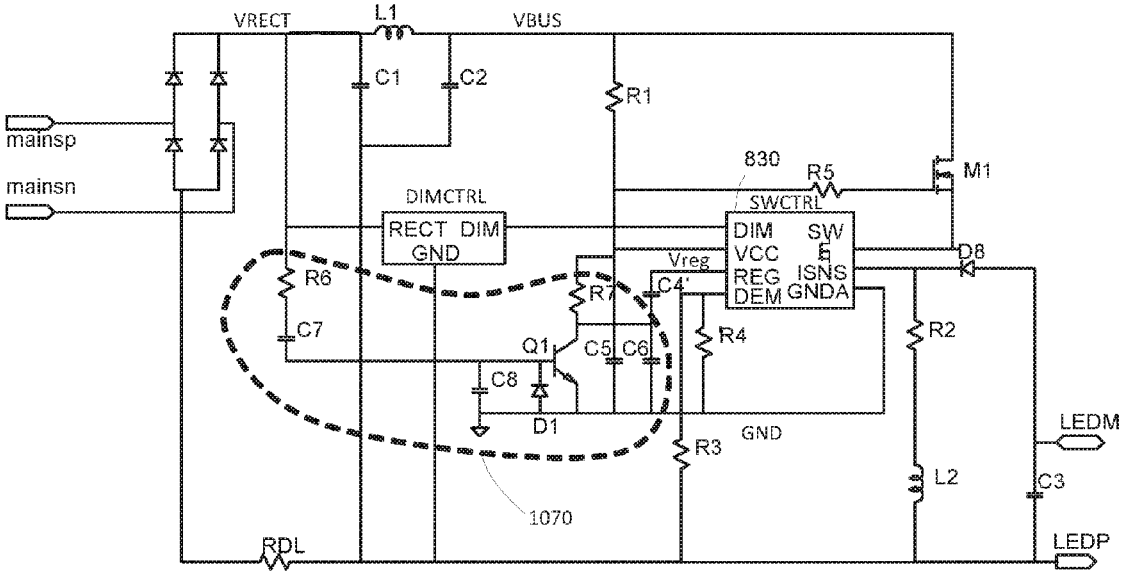
FIG. 10 illustrates a further embodiment in which the converter is extended by an additional waveform shaping circuit.
Figure 11:
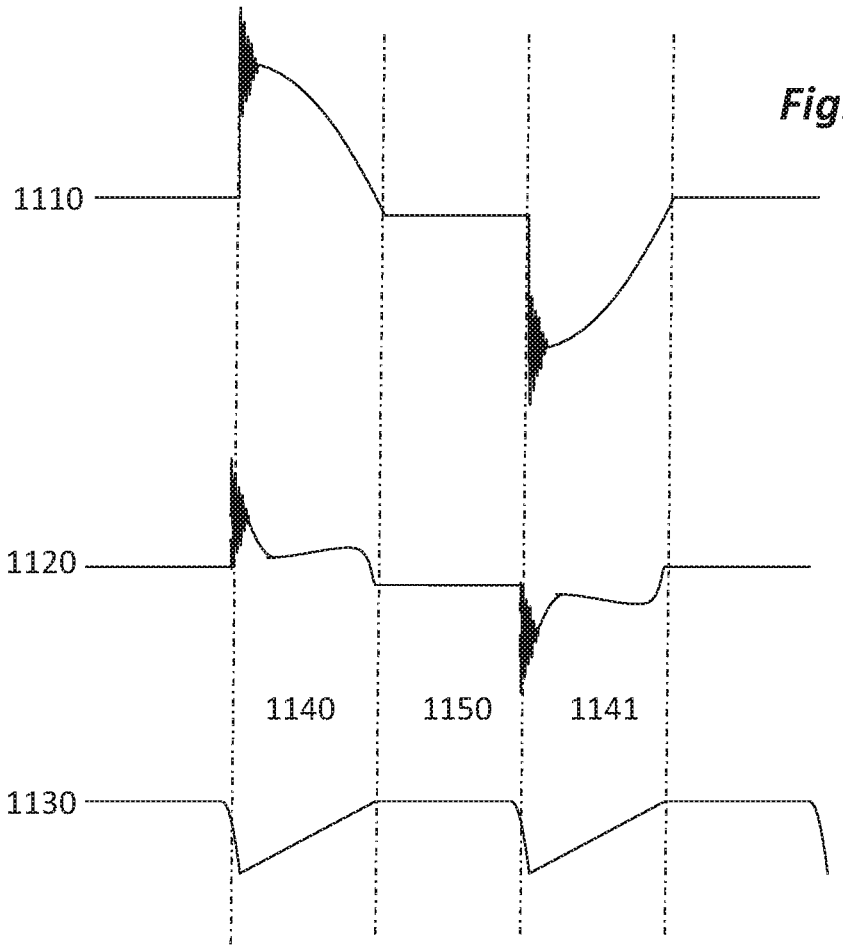
FIG. 11 shows waveforms which illustrate the operation of a waveform controller such as that shown in FIG. 10.

FIG. 10 shows a further embodiment in which the converter is extended by an additional waveform shaping circuit 1070, as shown schematically in FIGS. 4 and 5 at 470 and 570. FIG. 11 shows waveforms which illustrate the operation of a waveform controller such as that shown in FIG. 10, during time interval 1140 and 1141 (for the positive going half-cycle) and 1150 for the negative-going half cycles): the top curve 1110 shows the input voltage from a forward phase-cut dimmer; the middle curve 1120 shows the input current drawn by a solid state light source, and the bottom curve 1130 shows the voltage Vreg, which determines the "on-time" of the switched mode switch QSW 310,510.

The circuit 1070 allows a relatively higher current in the second half of the mains cycle—that is, once the phase has exceeded 90°. In this embodiment this is carried out by increasing the regulating voltage Vreg on the loop regulation pin REG of the converter controller 830, as follows: whilst the rectified input voltage Vrect decreases—after the 90° degrees phase of the AC input signal—the average voltage across capacitor C7 which is approximately equal to the average value of Vrect, will also decrease. As a result, the current through C7 will discharge C8 between base and emitter of Q1 such that Q1 stops conducting. The loop filter consisting of C8 and C4 will then be charged by the current through R7. As illustrated in FIG. 11, the loop control voltage Vreg will gradually ramp-up, increase the on-time of the converter and hence the input current of the solid state light. The state of extended on-time will persist during interval 1150 until the input voltage Vrect rises, which is at the start of the next dimmer conduction cycle. The capacitor C7 will then quickly charge C8 such that Q1 starts conducting and Ton is reset to the initial low value. So the compensation circuit is effectively compensating the droop of input current caused by the EMI filter capacitors C1 and C2. The function of R6 is to limit the peak current into the base of Q1 at fast transients of the input voltage. D1 serves to clamp the base voltage when Q1 does not conduct. C8 serves to suppress the high-frequency current that results from the high-frequency switching of the high-side switch. Note that although the average voltage at the ground of the switch controller equals the voltage at the return ground LEDP, the full swing input voltage is present across L2.

Figure 12:
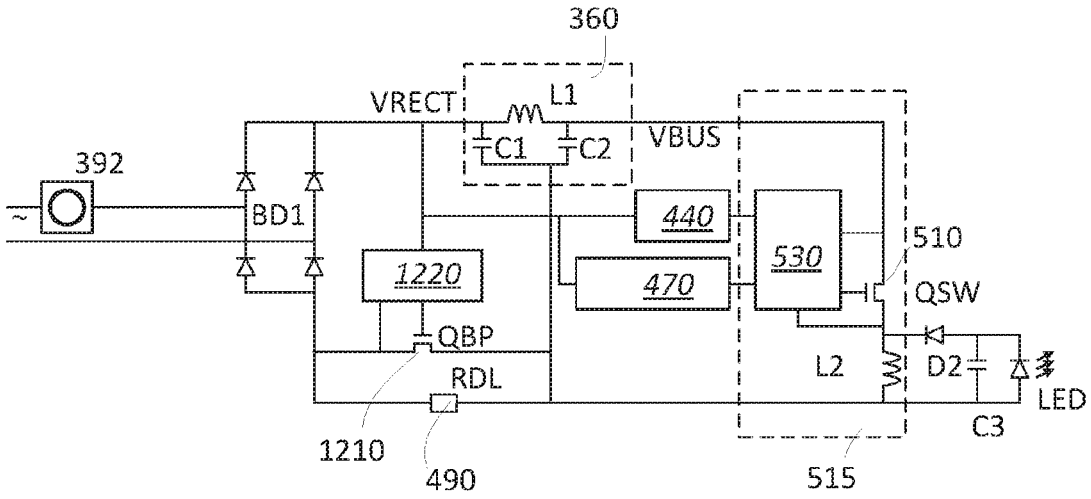
FIG. 12 shows a further embodiment, in which the switched mode converter is a high side buck boost converter, comprising a bypass switch

A further embodiment is shown in FIG. 12. This embodiment is similar to that shown in FIG. 5, in that the switched mode converter is a high side buck boost converter, and comprises a combined damping/latching resistance RDL 490 between the low side output of the bridge rectifier BD1 and the ground of the switched mode converter 515. However, in this embodiment, a bypass switch QBP 1210 is provided, which can provide a low ohmic bypass path around the combined damping/latching resistance RDL 490. The bypass switch is controlled by a bypass controller 1220. The bypass controller is arranged and configured to close the bypass switch at the end of a predetermined interval after the dimmer 392 starts to conduct. The predetermined moment is chosen to be after the switch has latched on, and so will generally be in the range of 50 μs to 300 μs after the turn-on moment of the dimmer.

Figure 13:
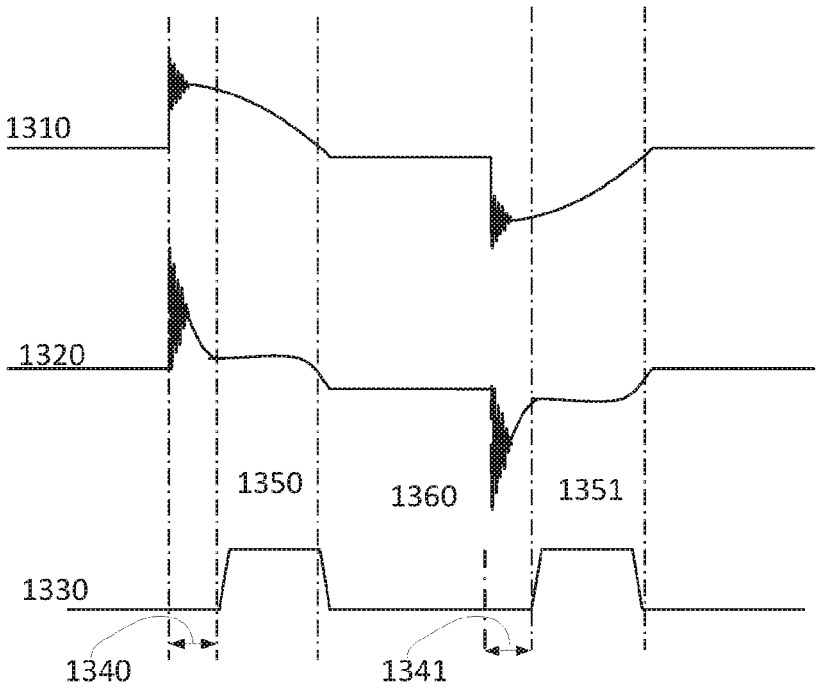
FIG. 13 shows waveforms which illustrate the operation of a waveform controller such as that shown in FIG. 12.

FIG. 13 shows the resulting waveforms corresponding to the embodiment shown in FIG. 212, in operation with a forward phase-cut dimmer: at 1310 is shown the input voltage; at 1320 is shown the input current drawn by the solid state lighting—which in this case is the string of LEDs, and at 1330 is shown the gate signal on the bypass switch QBP. The bypass switch is closed (corresponding to a rising edge to the gate signal 1330) at a moment, which is at the end of a predetermined interval or period 1340 after the dimmer starts to conduct. The bypass switch remains closed or on until the mains current falls to zero, and the triac stops conducting. The bypass switch remains open for the leading phase-cut period shown as interval 1360, and for a subsequent predetermined interval, 1341.

Of course, it will be appreciated that in common with other embodiments, some or all of the control functions may be carried out in the same controller. That is to say, with respect to this embodiment, some or all of the control functions carried out by the switched mode controller 530, bypass controller 1210, dimming controller 440 and waveform shaper 470 controllers shown separately, may be carried out in the same controller.

Although the switched mode converter shown in FIG. 12 is a high side buck boost converter, the bypass switch may also be applicable to other converter types, such as without limitation the low side buck boost converter shown in FIG. 5.

From reading the present disclosure, other variations and modifications will be apparent to the skilled person. Such variations and modifications may involve equivalent and other features which are already known in the art of lighting circuits, and which may be used instead of, or in addition to, features already described herein.

Although the appended claims are directed to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination.

The applicant hereby gives notice that new claims may be formulated to such features and/or combinations of such features during the prosecution of the present application or of any further application derived therefrom.

For the sake of completeness it is also stated that the term "comprising" does not exclude other elements or steps, the term "a" or "an" does not exclude a plurality, a single processor or other unit may fulfil the functions of several means recited in the claims and reference signs in the claims shall not be construed as limiting the scope of the claims.

The invention claimed is:

1. A lighting circuit for mains LED lighting applications operable with a phase-cut dimmer, wherein the mains has a maximum voltage which is at least 200V, the circuit comprising:

a rectifier having a low side output and a high side output;

a switched mode converter comprising a switch and an inductive element, having a high side input connected to a bus rail, and having a configuration so as to draw current from the mains across a complete mains cycle;

a controller for the switched mode converter;

a filter circuit connected between the rectifier high side output and the bus rail and comprising a capacitor connected between the high side output of the rectifier and ground;

a waveform shaping circuit arranged to provide a higher input current to the switched mode converter by increasing an on time of the switched mode converter when a momentary phase of the mains input signal exceeds 90°; and a combined damping/latch resistance connected between the low side output of the rectifier and ground.

2. The lighting circuit of claim 1, wherein the value of the combined damping/latch resistance is such that the RC time constant of the combined damping/latch resistance and filter circuit is greater than the time required for any ringing in the circuit to fall to no more than 20 mA.

3. The lighting circuit of claim 1, wherein the value of the combined damping/latch resistance is at least one of between 150Ω and 1 kΩ, and between 150Ω and 560Ω.

4. The lighting circuit of claim 1, wherein the switched mode converter is a one of a buck-boost converter, a fly-back converter, a boost converter, and a sepic converter.

5. The lighting circuit of claim 1, wherein the controller is configured to operate the switched mode converter in boundary conduction mode.

6. The lighting circuit of claim 1, wherein the RC time constant of the combined damping/latch resistance and filter circuit is between 50 μs and 300 μs.

7. The lighting circuit of claim 1, wherein the controller is configured to operate the switched mode convertor using on-time control.

8. The lighting circuit of claim 1, wherein the filter circuit further comprises an inductor between the rectifier high side output and the bus rail and a further capacitor connected between the bus rail and ground.

9. The lighting circuit of claim 1, further comprising a bypass switch, arranged and configured to, in use, provide a bypass path to bypass the combined damping/latching resistance at the end of a predetermined interval from a moment the dimmer starts conducting.

10. The lighting circuit of claim 1, further comprising one or more LEDs.

11. A populated driver circuit board, comprising the waveform shaping circuit, the rectifier, the switched mode converter, and the filter circuit, each as claimed in claim 1 and mounted on a common printed circuit board, and being configured to operate in a lighting circuit.

12. A lighting circuit, comprising the populated driver circuit board as claimed in claim 11, and a populated LED circuit board comprising at least one LED and the combined damping/latch resistance.

13. The lighting circuit of claim 12, wherein electrical connection between the populated driver circuit board and the populated LED circuit board is provided by three conductors.

14. A luminaire, comprising the lighting circuit as claimed in claim 12 configured in a housing.

15. The lighting circuit of claim 1, wherein the waveform shaping circuit is coupled to the high side output of the rectifier.

16. The lighting circuit of claim 15, wherein the waveform shaping circuit comprises a control switch and a loop filter, and wherein the control switch is turned off and the loop filter is controlled to be charged to increase a loop control voltage in order to increase the on time when the momentary phase of the mains input signal exceeds 90°.

* * * * *